US005641311A

United States Patent [19]

Chuang

[11] Patent Number: 5,641,311

[45] Date of Patent: Jun. 24, 1997

[54] ELECTRIC PLUG BLADE STRUCTURE

[76] Inventor: Wen-Piao Chuang, 3F, No. 143, Tai-Hua Road, ChungLi City, Taiwan

[21] Appl. No.: 555,279

[22] Filed: Nov. 8, 1995

[51] Int. Cl.[6] ..... H01R 13/04

[52] U.S. Cl. ..... 439/693

[58] Field of Search ..... 439/693, 885

[56] References Cited

U.S. PATENT DOCUMENTS 3,533,052 10/1970 Degaetano ..... 439/693 OR
3,710,287 1/1973 Eckert ..... 439/693 OR

FOREIGN PATENT DOCUMENTS 0005983 12/1979 European Pat. Off. ..... 439/693

*Primary Examiner*—David L. Pirlot
*Assistant Examiner*—Daniel Wittels
*Attorney, Agent, or Firm*—Oppenheimer Poms Smith

[57] ABSTRACT

An electric plug blade made of a conductive material has two sections of recesses formed in the rear part of the blade. An insulation material houses the rear part of the blade to define an insulation part, and the front part of the blade remains unhoused by the insulation material for connecting to a wall outlet.

6 Claims, 3 Drawing Sheets

ELECTRIC PLUG BLADE STRUCTURE

FIELD OF THE PRESENT INVENTION

The invention relates generally to an electric plug and in particular to the blade structure of an electric plug having two phases of recess surrounded with insulation material.

BACKGROUND OF THE INVENTION

Generally, electric plugs have conductive blades made of, for example, metal partially embedded in an insulation housing of the plug. A portion of each of the blades is exposed for insertion and establishing electrical connection with a socket or wall outlet. Sometimes, when a plug is not fully inserted into a socket, an accidental touch to the exposed portion of the plug blade may cause an electrical shock. This is especially dangerous to children playing near the socket. Therefore, it is desirable to make a safer plug.

SUMMARY OF THE INVENTION

It is therefore an object of the present invention to provide an electric plug having better insulation effect. The rear part of the electric plug blade forms two sections of recesses which are surrounded by an insulation material, making a safer portion when compared with the prior electric plug blade. This alternation of the electric plug blade enhances the safety in using electric plugs.

Another object of the present invention is to provide an electric plug blade with both the functions of beauty and practical usage. The thickness of the insulation material surrounding the rear part of the electric plug blade is the same as the surface of the front part of the electric plug blade. Therefore, although the present invention though has two recesses, the appearance of the present invention still appeals to stages of visual effect and smooth surface.

The present invention as will be described by the accompanying drawings and the description is not to limit the scope or spirit of the invention. They are merely described as preferred embodiments of the present invention.

BRIEF DESCRIPTION OF THE DRAWINGS

Reference is now made to the accompanying drawings, in which it is shown an illustrative embodiment of the present invention from which its novel features and advantages will be apparent, wherein.

DETAILED DESCRIPTION OF THE PREFERRED EMBODIMENT

Figure 1:
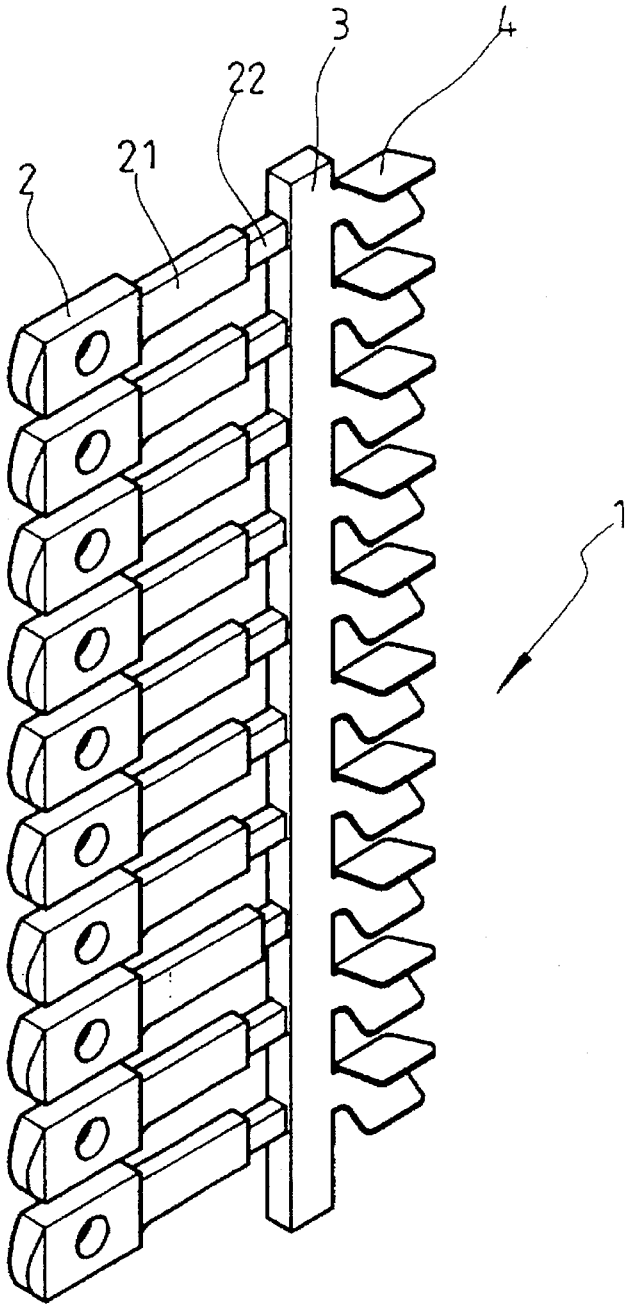
FIG. 1 is a perspective view of a partially completed blank of the present invention with a plurality of plug blades in accordance with the present invention partially formed thereon.
Figure 2:
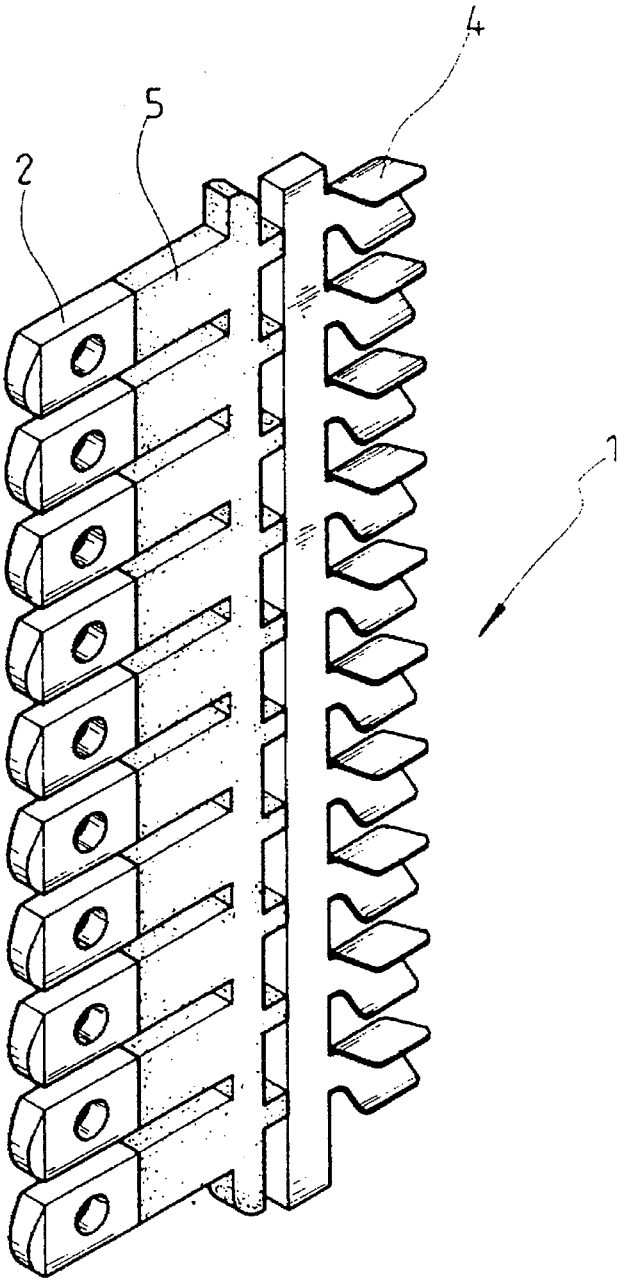
FIG. 2 is also a perspective view of the blank of the present invention with the recessed sections of the plug blades housed by an insulation material.

With reference to the drawings, and in particular to FIG. 1, wherein a blank with partially formed electric plug blades 2 constructed with a conductive material, defining body portions of the blades, in accordance with the present invention is shown. In the preferred embodiment of the invention, two sections of recesses 21, 22 are formed at the rear part of each of the electric plug blades 2 which are in turn connected to an elongated rod 3 and having a socket 4 for connecting to a conductive wire for the construction of a plug. Referring to FIG. 2, which shows a perspective view of the blank in accordance with the invention before cutting and mounting to an insulating housing of the plug, wherein each of the electric plug blades 2 has been surrounded with an insulation material 5 at the recesses 21 and 22. As shown in the figure, the recesses 21 and 22 are surrounded with insulation material 5 which makes the rear part of the electric plug blade 2 an extension of insulation and the front part exposed for connecting to the wall outlet. In the preferred embodiment of the invention, the recesses 21, 22 are surrounded with the insulation material 5, such that the overall thickness of the rear part is substantially the same as the thickness of the front part of each of the plug blades 2, and the rear part of the plug blade 2 appears to be a smooth surface after the insulation material 5 is secured on the recesses 21, 22.

Figure 3:
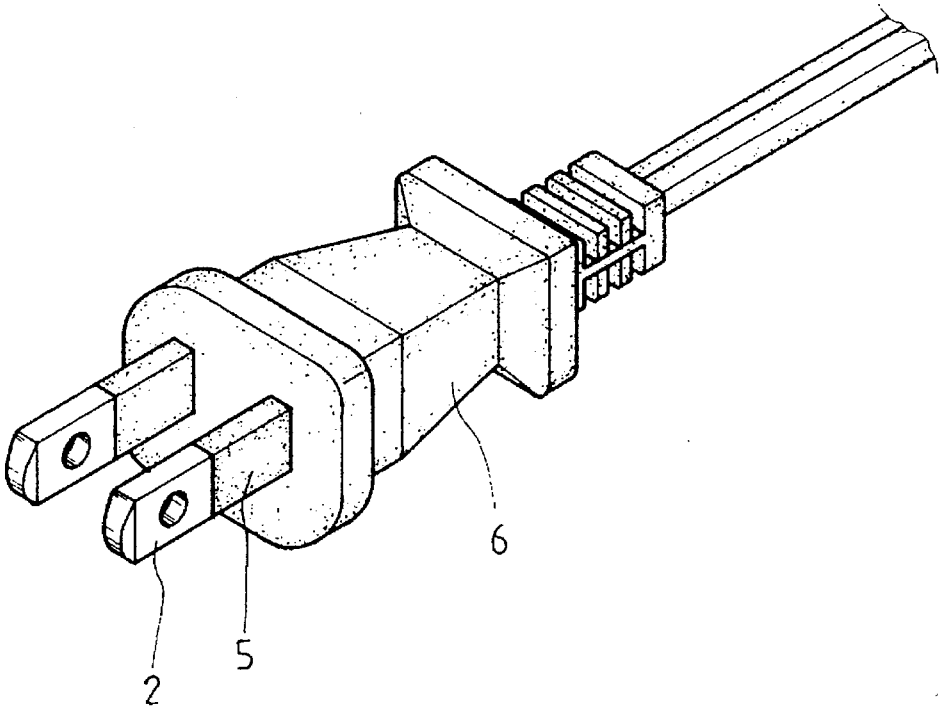
FIG. 3 is a perspective view showing a plug constructed in accordance with the present invention.

Referring to FIG. 3, a perspective view of the plug blade 2 that is assembled in an insulation housing 6 is shown. The plug blade 2 of FIG. 2 is first cut off from the blank structure of the invention and then secured within the housing 6 with the front part of the plug blade 2 projecting out of the insulation housing 6 a suitable distance for connection with the wall outlet.

Although a preferred embodiment has been described to illustrate the present invention, it is apparent that changes and modifications in the specifically described embodiments can be carried out without departing from the scope of the invention which is intended to be limited only by the appended claims.

What we claim is:

1. An electric plug blade having a pair of recesses formed in a rear part of the blade, with an insulation material surrounding the rear part of the blade and secured to the recesses to define an insulation part of the blade with front part of the blade remaining unhoused by the insulation material for connecting to a wall outlet, the rear part of the blade being receivable in an insulation housing of a plug such that a portion of the insulation part projects out of the insulation housing of the plug.

2. The electric plug blade as claimed in claim 1, wherein said insulation material has a thickness substantially the same as the thickness of the front part of said blade.

3. The electric plug blade as claimed in claim 1, wherein the recesses have different depths and juxtapose each other along the blade.

4. An electric plug blade comprising:

a) a body portion formed of conductive material and having a front part and a rear part;

b) a first recess formed in the rear part of the body portion;

c) a second recess formed in the rear part of the body portion; and d) an insulation part formed around the rear part of the body portion;

the body portion being unitary and solid in construction;

the front part of the body portion remaining uninsulated and conductive for connecting to a wall outlet;

the first recess being positioned between the front part of the body portion and the second recess;

the first recess being greater in dimension than the second recess and less in dimension than the front part of the body portion;

the insulation part including insulative material surrounding the rear part of the body portion and secured to the first recess and the second recess; and the rear part of the body portion being securable within an insulation housing of a plug such that a portion of the insulation part projects out of the insulation housing of the plug.

5. The electric plug blade of claim 4 wherein the insulation part is substantially the same in dimension as the front part of the body portion.

6. An electric plug comprising:

a) an insulation housing; and b) a pair of plug blades each including:

(1) a body portion formed of conductive material and having a front part and a rear part;

(2) a first recess formed in the rear part of the body portion;

(3) a second recess formed in the rear part of the body portion; and (4) an insulation part formed around the rear part of the body portion;

the body portion of each plug blade being unitary and solid in construction;

the front part of each body portion remaining uninsulated and conductive for connecting to a wall outlet;

the first recess of each body portion being positioned between the front part of the body portion and the second recess;

the first recess of each body portion being greater in dimension than the second recess and less in dimension than the front part of the body portion;

the insulation part of each plug blade including insulative material surrounding the rear part of the body portion and secured to the first recess and the second recess; and the rear part of each body portion being securable within the insulation housing such that a portion of the insulation part projects out of the insulation housing.

* * * * *